US011269271B2

(12) United States Patent
Goto et al.

(10) Patent No.: US 11,269,271 B2
(45) Date of Patent: Mar. 8, 2022

(54) ROLLER UNIT, BELT DEVICE AND IMAGE FORMING APPARATUS

(71) Applicants: Yutaka Goto, Kanagawa (JP); Seiichi Kogure, Kanagawa (JP); Atsushi Nakamoto, Kanagawa (JP); Daisuke Hamada, Kanagawa (JP); Takuya Akiyama, Kanagawa (JP); Yuuki Aoki, Tokyo (JP)

(72) Inventors: Yutaka Goto, Kanagawa (JP); Seiichi Kogure, Kanagawa (JP); Atsushi Nakamoto, Kanagawa (JP); Daisuke Hamada, Kanagawa (JP); Takuya Akiyama, Kanagawa (JP); Yuuki Aoki, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/147,536

(22) Filed: Jan. 13, 2021

(65) Prior Publication Data

US 2021/0223721 A1 Jul. 22, 2021

(30) Foreign Application Priority Data

Jan. 17, 2020 (JP) ..... JP2020-005803

(51) Int. Cl.
*G03G 15/20* (2006.01)
*G03G 15/16* (2006.01)

(52) U.S. Cl.
CPC ..... *G03G 15/1615* (2013.01)

(58) Field of Classification Search
CPC ..... G03G 15/1615; G03G 15/754
USPC ..... 399/162, 165, 302, 308, 313
See application file for complete search history.

(56) References Cited

U.S. PATENT DOCUMENTS

| | | | | |
|---|---|---|---|---|
| 9,042,779 | B2 * | 5/2015 | Kogure | G03G 15/1615 399/121 |
| 2011/0058859 | A1 | 3/2011 | Nakamatsu et al. | |
| 2011/0211855 | A1 | 9/2011 | Kogure et al. | |
| 2013/0216260 | A1 | 8/2013 | Kogure et al. | |
| 2014/0241744 | A1 | 8/2014 | Ichikawa et al. | |
| 2015/0268591 | A1 | 9/2015 | Fujita et al. | |
| 2016/0041508 | A1 | 2/2016 | Kogure et al. | |
| 2016/0170363 | A1 | 6/2016 | Kogure et al. | |
| 2016/0170364 | A1 | 6/2016 | Kogure et al. | |
| 2017/0090374 | A1 | 3/2017 | Fujita et al. | |
| 2018/0046115 | A1 | 2/2018 | Fujita et al. | |
| 2018/0059595 | A1 | 3/2018 | Akiyama et al. | |
| 2018/0143570 | A1 | 5/2018 | Mizutani et al. | |

(Continued)

FOREIGN PATENT DOCUMENTS

| | | |
|---|---|---|
| JP | 2008-129448 | 6/2008 |
| JP | 2012-068556 | 4/2012 |

*Primary Examiner* — Hoan H Tran
(74) *Attorney, Agent, or Firm* — Xsensus LLP

(57) ABSTRACT

A roller unit includes a roller, an arm, a holder, a tension spring, and a restriction member. The arm rotatably holds the roller. The holder swingably holds the arm. The tension spring includes a first hook at one end of the tension spring and a second hook at another end of the tension spring. The first hook is hooked on an arm-side hook of the arm. The second hook is hooked on a holder-side hook of the holder. The restriction member is configured to restrict movement of the tension spring in a state in which the first hook or the second hook is unhooked.

14 Claims, 6 Drawing Sheets

(56) References Cited

U.S. PATENT DOCUMENTS

| | | | |
|---|---|---|---|
| 2018/0157196 | A1 | 6/2018 | Kogure et al. |
| 2018/0157209 | A1 | 6/2018 | Fujita et al. |
| 2018/0341201 | A1 | 11/2018 | Kogure et al. |

* cited by examiner

ROLLER UNIT, BELT DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-005803, filed on Jan. 17, 2020, in the Japan Patent Office, the entire disclosure of which is hereby incorporated by reference herein.

BACKGROUND

Technical Field

Embodiments of the present disclosure relate to a roller unit including a roller such as a tension roller, a belt device including a belt member such as an intermediate transfer belt, a transfer conveyance belt, a photoconductor belt, or a fixing belt that travels in a predetermined direction, and an image forming apparatus such as a copying machine, a printer, a facsimile machine, or a multifunction peripheral thereof including the roller unit and the belt device.

Description of the Related Art

There is known a technology in which a tension roller that applies tension to a belt such as an intermediate transfer belt is installed in an image forming apparatus such as a copying machine or a printer.

The intermediate transfer belt is stretched taut and supported by a plurality of rollers. At least one of the plurality of rollers is biased by a biasing member such as a spring in a direction in which tension is applied to the intermediate transfer belt. According to such a configuration, the intermediate transfer belt travels well in a state in which a desired tension is applied by the tension roller without slackening.

SUMMARY

In an aspect of the present disclosure, a roller unit includes a roller, an arm, a holder, a tension spring, and a restriction member. The arm rotatably holds the roller. The holder swingably holds the arm. The tension spring includes a first hook at one end of the tension spring and a second hook at another end of the tension spring. The first hook is hooked on an arm-side hook of the arm. The second hook is hooked on a holder-side hook of the holder. The restriction member is configured to restrict movement of the tension spring in a state in which the first hook or the second hook is unhooked.

In another aspect of the present disclosure, a belt device includes a belt configured to travel in a predetermined direction. The roller unit is detachably attached to the belt device. The roller is a tension roller configured to apply tension to the belt.

In still another aspect of the present disclosure, an image forming apparatus includes the belt device, an image forming device, and a belt facing member. The image forming device forms a toner image on an outer circumferential surface of the belt provided in the belt device. The belt facing member forms a nip to sandwich a sheet between the belt facing member and the belt.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
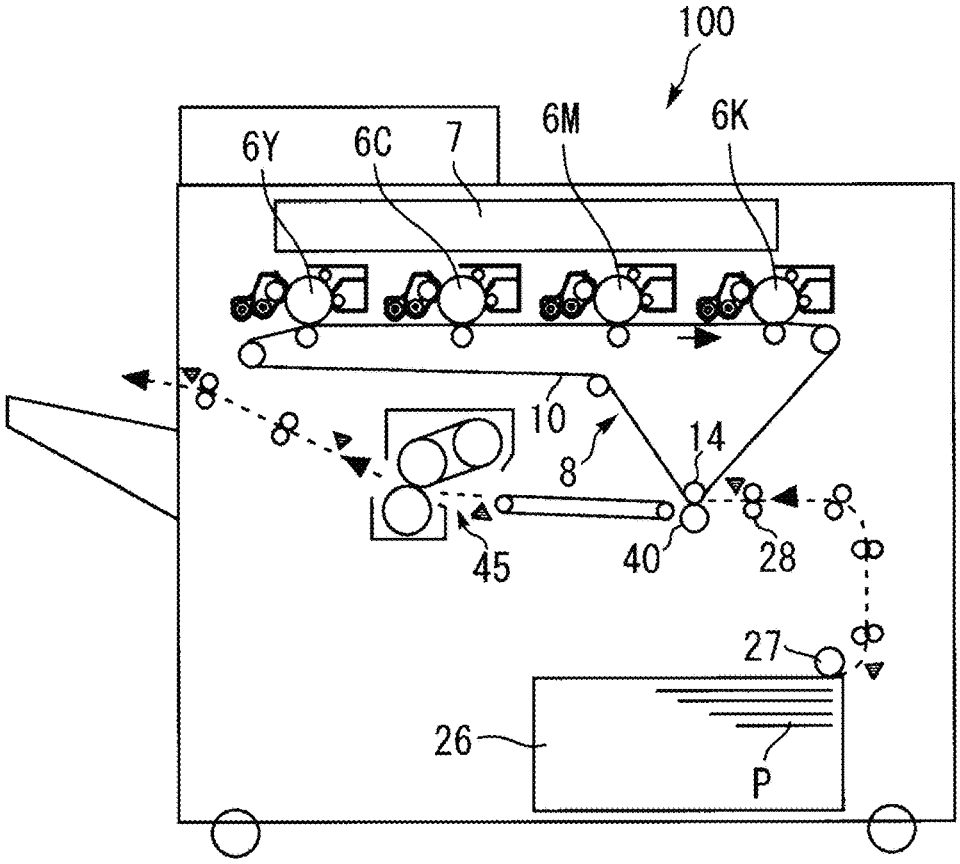
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments according to the present disclosure are described in detail with reference to drawings. Identical reference numerals are assigned to identical components or equivalents and redundant descriptions of those components are simplified or omitted.

A configuration and operation of an image forming apparatus 100 is described below with reference to FIGS. 1 and 2.

FIG. 1 is a schematic view of a configuration of the image forming apparatus 100 as a printer. FIG. 2 is an enlarged view of an image forming device of the image forming apparatus 100.

As illustrated in FIG. 1, an intermediate transfer belt device 8 as a belt device is provided in a center of a body of the image forming apparatus 100. Image forming devices 6Y, 6M, 6C, and 6K corresponding to respective colors (yellow, magenta, cyan, and black) are arranged in parallel so as to face an intermediate transfer belt 10 (as a belt member) of the intermediate transfer belt device 8.

Figure 2:
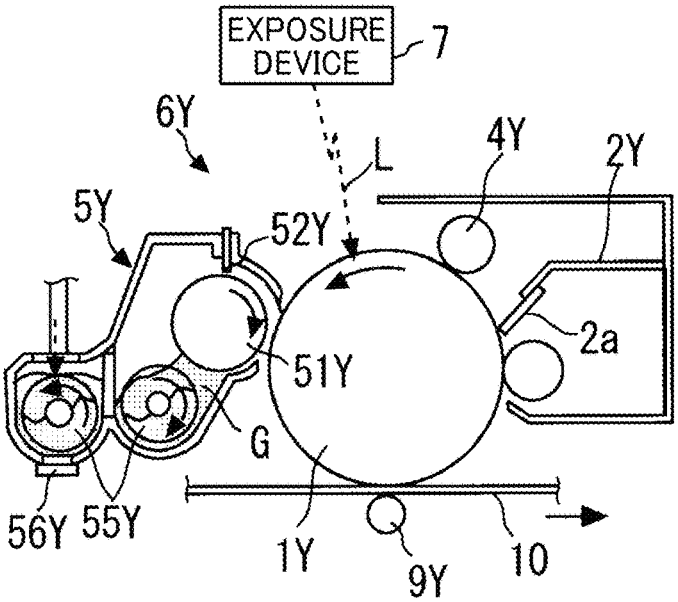
FIG. 2 is a schematic enlarged view of a configuration of an image forming device of the image forming apparatus.

As illustrated in FIG. 2, the image forming device 6Y corresponding to yellow includes a photoconductor drum 1Y (photoconductor) as an image bearer, a charger 4Y, a developing device 5Y, a cleaner 2Y, a discharger, and the like. The charger 4Y, the developing device 5Y, the cleaner 2Y, the discharger, and the like are disposed around the photoconductor drum 1Y. An image formation process (including charging, exposure, development, transfer, and cleaning steps) is performed on the photoconductor drum 1Y to form a yellow toner image on the photoconductor drum 1Y.

Note that the other three image forming devices 6M, 6C, and 6K have substantially the same configuration as the configuration of the image forming device 6Y corresponding to yellow except that colors of toner used are different and images corresponding to the respective toner colors are formed. Hereinafter, descriptions of the other three image forming devices 6M, 6C, and 6K are appropriately omitted and only the image forming device 6Y corresponding to yellow is described.

With reference to FIG. 2, the photoconductor drum 1Y is driven to rotate counterclockwise by a motor. The surface of the photoconductor drum 1Y is uniformly charged at the position of the charger 4Y (charging step).

Thereafter, the surface of the photoconductor drum 1Y reaches an irradiation position of laser light L emitted from an exposure device 7 and an electrostatic latent image corresponding to yellow is formed by exposure scanning at this position (exposure step).

Subsequently, the surface of the photoconductor drum 1Y reaches a position facing the developing device 5Y and the electrostatic latent image is developed into a toner image of yellow at this position (development step).

Thereafter, the surface of the photoconductor drum 1Y reaches a position facing the intermediate transfer belt 10 (as a belt member) and a primary transfer roller 9Y. The toner image on the photoconductor drum 1Y is transferred onto the intermediate transfer belt 10 at this position (primary transfer step). At this time, a certain amount of untransferred toner remains on the photoconductor drum 1Y.

Then, the surface of the photoconductor drum 1Y reaches a position facing the cleaner 2Y. At this position, a cleaning blade 2*a* collects the residual untransferred toner from the surface of the photoconductor drum 1Y into the cleaner 2Y (cleaning step).

Lastly, the surface of the photoconductor drum 1Y reaches a position facing the discharger and the discharger removes residual potentials from the photoconductor drum 1Y.

As described above, a sequence of the image forming process performed on the photoconductor drum 1Y is completed.

The above-described image forming process is performed in the image forming devices 6M, 6C, and 6K similarly to the image forming device 6Y for yellow. That is, the exposure device 7 disposed above the image forming devices 6M, 6C, and 6K irradiates the photoconductor drums 1M, 1C, and 1K of the respective image forming devices 6M, 6C, and 6K with the laser beam L based on image data. Specifically, the exposure device 7 emits the laser beam L from a light source and irradiates the photoconductor drums 1M, 1C, and 1K with the laser beam L via multiple optical elements while deflecting the laser beam L with a polygon mirror that is driven to rotate.

Thereafter, the toner images of the respective colors formed on the respective photoconductor drums through the development step are superimposed and primarily transferred onto the intermediate transfer belt 10. Thus, a multicolor toner image is formed on the intermediate transfer belt 10.

Figure 3:
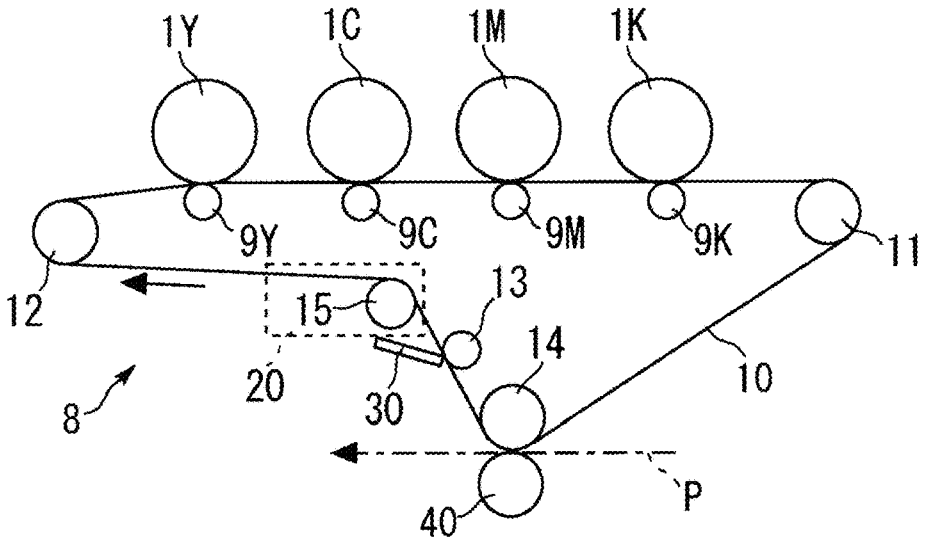
FIG. 3 is a schematic view of a configuration of an intermediate transfer belt device.

Here, with reference to FIG. 3, the intermediate transfer belt device 8 as a belt device includes the intermediate transfer belt 10 serving as a belt member, the four primary transfer rollers 9Y, 9M, 9C, and 9K, a driving roller 11, a driven roller 12, a secondary transfer facing roller 14, a tension roller 15, a cleaner facing roller 13, an intermediate transfer belt cleaner 30, a secondary transfer roller 40, and the like. The intermediate transfer belt 10 is stretched taut and supported by the plurality of rollers, that is, the driving roller 11, the driven roller 12, the secondary transfer facing roller 14, the tension roller 15. The intermediate transfer belt 10 is also endlessly moved in a direction indicated by an arrow in FIG. 3 by rotation of one roller (driving roller 11), which is driven by a driving motor.

The four primary transfer rollers 9Y, 9M, 9C, and 9K sandwich the intermediate transfer belt 10 with the photoconductor drums 1Y, 1M, 1C, and 1K, respectively, to form primary transfer nips. A transfer voltage (primary transfer bias) having a polarity opposite to the polarity of toner is applied to the primary transfer rollers 9Y, 9M, 9C, and 9K.

Then, the intermediate transfer belt 10 travels in the direction indicated by the arrow in FIG. 3 and sequentially passes through the primary transfer nips of the primary transfer rollers 9Y, 9M, 9C, and 9K. In this manner, the toner images of the respective colors on the photoconductor drums 1Y, 1M, 1C, and 1K are primarily transferred onto the intermediate transfer belt 10 in a superimposed manner.

After that, the intermediate transfer belt 10 on which the toner images of the respective colors are superimposed and primarily transferred reaches a position facing the secondary transfer roller 40. At this position, the secondary transfer facing roller 14 and the secondary transfer roller 40 sandwich the intermediate transfer belt 10 to form a secondary transfer nip. In FIG. 1, the secondary transfer facing roller 14 serves as a belt facing member that is disposed to face the secondary transfer roller 40 to form the secondary transfer nip. Note that the belt facing member is not limited to a roller such as the secondary transfer facing roller 14 and may be, for example, a belt. Then, the toner images of the four colors formed on the intermediate transfer belt 10 are secondarily transferred onto a sheet P such as a sheet of paper conveyed to the position of the secondary transfer nip. At this time, untransferred toner that has not been transferred onto the sheet P remains on the surface of the intermediate transfer belt 10.

Then, the intermediate transfer belt 10 reaches a position of the intermediate transfer belt cleaner 30. At this position, the untransferred toner on the intermediate transfer belt 10 is removed.

Thus, a series of an image transfer process performed on the intermediate transfer belt 10 is completed.

With reference to FIG. 1, the sheet P conveyed to the position of the secondary transfer nip is conveyed from a sheet feeding unit 26 disposed in a lower part of the body of the image forming apparatus 100 via a sheet feeding roller 27, a registration roller pair 28, and the like.

Specifically, a plurality of sheets P such as sheets of paper are stacked and stored in the sheet feeding unit 26. Then, when the sheet feeding roller 27 is driven to rotate counterclockwise as illustrated in FIG. 1, an uppermost sheet P is fed toward between rollers of the registration roller pair 28.

The sheet P is conveyed by the registration roller pair (timing roller pair) 28 and temporarily stops at a position of a roller nip of the registration roller pair 28 that has stopped driving to rotate. Then, the registration roller pair 28 is driven to rotate in synchronization with a color image on the intermediate transfer belt 10, and the sheet P is conveyed toward the secondary transfer nip. Thus, a desired color image is transferred onto the sheet P.

Thereafter, the sheet P on which the color image has been transferred at the position of the secondary transfer nip is conveyed to the position of the fixing unit 45. At this position, the fixing belt and a pressure roller apply heat and pressure to the sheet P to fix the color toner image onto the sheet P.

Thereafter, the sheet P is ejected outside of the image forming apparatus 100 by an ejection roller pair. The sheets P ejected by the ejection roller pair are sequentially stacked as output image documents on a stack tray.

Thus, a series of the image forming process performed by the image forming apparatus 100 is completed.

Next, with reference to FIG. 2, a configuration and operation of the developing device 5Y (as a developing device) of the image forming device 6Y, is described in detail.

The developing device 5Y includes a developing roller 51Y, a doctor blade 52Y, two conveyance screws 55Y, and a concentration detection sensor 56Y, and the like. The developing roller 51Y is disposed facing the photoconductor drum 1Y. The doctor blade 52Y is disposed facing the developing roller 51Y. The two conveyance screws 55Y are provided in a developer container. The concentration detection sensor 56Y detects toner concentration in the developer. The developing roller 51Y includes stationary magnets inside the developing roller 51Y, a sleeve that rotates around the magnets, and the like. A two-component developer composed of a carrier and toner is contained in the developer container.

The developing device 5Y configured as described above operates as follows.

The sleeve of the developing roller 51Y rotates in a direction indicated by an arrow (illustrated inside the developing roller 51Y) in FIG. 2. A developer G is borne on the developing roller 51Y by a magnetic field generated by the magnets. As the sleeve of the developing roller 51Y rotates, the developer G moves along the circumference of the developing roller 51. Here, the developer Gin the developing device 5Y is adjusted so that the ratio of toner (toner concentration) in the developer G falls within a predetermined range.

Thereafter, the toner supplied into the developer container is circulated (or moved in a direction perpendicular to a plane on which FIG. 2 is illustrated) through the isolated two developer containers while being mixed and stirred together with the developer G by the two conveyance screws 55Y. The toner in the developer G is charged by triboelectric charging with the carrier and attracted to the carrier. Then, the toner is borne on the developing roller 51Y together with the carrier by a magnetic force generated on the developing roller 51Y.

The developer G borne on the developing roller 51Y is conveyed in the direction indicated by the arrows illustrated in the developing device 5Y of FIG. 2 and reaches the position of the doctor blade 52Y. The amount of developer G on the developing roller 51Y is adjusted at the position of the doctor blade 52Y. Thereafter, the developer G is conveyed to a position (developing region) facing the photoconductor drum 1Y. Then, the toner is attracted to the electrostatic latent image formed on the photoconductor drum 1Y due to the effect of an electric field generated in the development region. Thereafter, the developer G remaining on the developing roller 51Y reaches an upper portion of the developer container in conjunction with the rotation of the sleeve and is separated from the developing roller 51Y at this position.

Next, the intermediate transfer belt device 8 (as a belt device) according to an embodiment of the present disclosure is described in detail with reference to FIG. 3.

With reference to FIG. 3, the intermediate transfer belt device 8 as a belt device includes the intermediate transfer belt 10 as a belt member, the four primary transfer rollers 9Y, 9M, 9C, and 9K, the driving roller 11, the driven roller 12, the secondary transfer facing roller 14, the tension roller 15, the cleaner facing roller 13, the intermediate transfer belt cleaner 30, and the secondary transfer roller 40.

The intermediate transfer belt 10 (belt member) is disposed so as to face the four photoconductor drums 1Y, 1M, 1C, and 1K that bear toner images of the respective colors. The intermediate transfer belt 10 is stretched taut and supported mainly by five rollers (the driving roller 11, the driven roller 12, the secondary transfer facing roller 14, the tension roller 15, and the cleaner facing roller 13).

In the present embodiment, the intermediate transfer belt 10 is a single-layer or multi-layer belt formed with a material(s) such as polyvinylidene fluoride (PVDF), ethylene-tetrafluoroethylene copolymer (ETFE), polyimide (PI), and polycarbonate (PC), and the like. A conductive material such as carbon black is dispersed in the intermediate transfer belt 10. The intermediate transfer belt 10 is adjusted to have a volume resistivity in a range of $10^6$ to $10^{13}$ Ωcm and a surface resistivity in a range of $10^7$ to $10^{13}$ Ωcm on the back side of the intermediate transfer belt 10. The intermediate transfer belt 10 is set to have a thickness in a range of 20 to 200 μm. In the present embodiment, the intermediate transfer belt 10 is set to have a thickness of about 60 μm and a volume resistivity of about $10^9$ Ωcm.

The intermediate transfer belt 10 may include a release layer coated on the surface of the intermediate transfer belt 10 as needed. Examples of a material usable for the release layer (coating) include fluororesin such as ethylene tetrafluoroethylene (ETFE), polytetrafluoroethylene (PTFE), polyvinylidene fluoride (PVDF), perfluoroalkoxy alkanes (PFA), tetrafluoroethylene-hexafluoropropylene copolymer (FEP), and polyvinyl fluoride (PVF). However, the material usable is not limited to thereto.

The intermediate transfer belt 10 is manufactured through a casting process, a centrifugal molding process, or the like. The surface of the intermediate transfer belt 10 may be polished as necessary. The volumetric resistivity of the intermediate transfer belt 10 was measured by using "Hiresta UP MCP HT45" (manufactured by Mitsubishi Chemical Corporation) under the condition of an application voltage 100 V.

The primary transfer rollers 9Y, 9M, 9C, and 9K face the photoconductor drums 1Y, 1M, 1C, and 1K, respectively, via the intermediate transfer belt 10. More specifically, the primary transfer roller 9Y for yellow faces the photoconductor drum 1Y for yellow via the intermediate transfer belt 10. The primary transfer roller 9M for magenta faces the photoconductor drum 1M for magenta via the intermediate transfer belt 10. The primary transfer roller 9C for cyan faces the photoconductor drum 1C for cyan via the intermediate transfer belt 10. The primary transfer roller 9K for black faces the photoconductor drum 1K for black via the intermediate transfer belt 10. Each of the primary transfer rollers 9Y, 9M, 9C, and 9K is an elastic roller in which a conductive sponge layer is formed on a core metal, and is adjusted to have a volumetric resistance in a range of $10^6$ to $10^{12}$ Ωcm (preferably, $10^7$ to $10^9$ Ωcm).

The driving roller 11 is driven to rotate by a drive motor controlled by a controller. Owing to this mechanism, the intermediate transfer belt 10 travels in a predetermined direction (clockwise in FIG. 3).

The tension roller 15 is a roller in which an elastic layer is formed on a core metal and is in contact with an outer circumferential surface of the intermediate transfer belt 10. The driven roller 12 is in contact with an inner circumferential surface of the intermediate transfer belt 10. The intermediate transfer belt cleaner 30 (cleaning blade) is disposed between the secondary transfer facing roller 14 and the tension roller 15 so as to face the cleaner facing roller 13 via the intermediate transfer belt 10. Each of the rollers 12 to 15 is driven to rotate along with rotation of the intermediate transfer belt 10.

With reference to FIG. 3, the secondary transfer facing roller 14 abuts against the secondary transfer roller 40 via the intermediate transfer belt 10. The secondary transfer facing roller 14 includes an elastic layer 83 (having a layer thickness of about 5 mm) on an outer circumferential surface of a cylindrical core metal made of stainless steel or the like. The elastic layer 83 is made of nitrile butadiene rubber (NBR) having a volumetric resistance of about $10^7$ to $10^8$ Ωcm and a hardness (JIS-A hardness) of about 48 to 58.

In the present embodiment, the secondary transfer facing roller 14 is electrically connected to a power source (bias output device). A secondary transfer bias having a high voltage of about −10 kV is applied to the secondary transfer facing roller 14 from the power source. The secondary transfer bias applied to the secondary transfer facing roller 14 secondarily transfers the toner image borne on the intermediate transfer belt 10 to the sheet P conveyed to the secondary transfer nip. The secondary transfer bias is a bias (direct current (DC) voltage) having the same polarity (negative polarity in the present embodiment) as the polarity of toner. Thus, the toner borne on a toner bearing surface (outer circumferential surface) of the intermediate transfer belt 10 is electrostatically moved from the secondary transfer facing roller 14 toward the secondary transfer roller 40 by a secondary transfer electric field.

The secondary transfer roller 40 is in contact with the toner bearing surface (outer circumferential surface) of the intermediate transfer belt 10 to form the secondary transfer nip to which the sheet P is conveyed. An elastic layer having a hardness (Asker C hardness) of about 40 to 50 degrees is formed (coated) around a hollow cored bar made of stainless steel, aluminum, or the like to obtain the secondary transfer roller 40. A conductive filler, such as carbon, is dispersed in a rubber material, such as polyurethane, ethylene-propylene-diene monomer (EPDM), silicone and the like, or an ionic conductive material is included in the rubber material to form the elastic layer of the secondary transfer roller 40 into a solid or foamed state. In the present embodiment, the elastic layer of the secondary transfer roller 40 has a volume resistivity ranging from about $10^{6.5}$ to $10^{7.5}$ Ωcm to prevent concentration of a transfer current.

Note that a release layer made of a semiconductive fluororesin or urethane resin may be formed on the surface of the secondary transfer roller 40 to enhance the releasability of toner from the surface of the secondary transfer roller 40.

Hereinafter, the configuration and operation of a roller unit 20 according to an embodiment of the present disclosure, which is installed detachably on the intermediate transfer belt device 8 of the image forming apparatus 100, is described in detail.

As described above with reference to FIG. 3 and the like, the intermediate transfer belt device 8 as a belt device includes the intermediate transfer belt 10 and the tension roller 15. The intermediate transfer belt 10 is a belt that travels in a predetermined direction. The tension roller 15 is a roller that applies tension to the intermediate transfer belt 10 from the outer circumferential surface of the intermediate transfer belt 10 from below.

In the present embodiment, the roller unit 20 (see FIGS. 4 and 5) including the tension roller 15 (roller) is detachably attached to the intermediate transfer belt device 8.

Specifically, the intermediate transfer belt device 8 is pulled out from the body of the image forming apparatus 100 to the front side in a direction perpendicular to plane in which FIG. 1 is illustrated. Then, an operator such as a user or a service representative performs maintenance of the intermediate transfer belt device 8 and the roller unit 20 in a state in which the tension to the intermediate transfer belt 10 by the tension roller 15 is released and the roller unit 20 is removed from the intermediate transfer belt device 8. After the maintenance as described above is finished, the roller unit 20 is attached to the intermediate transfer belt device 8, and the intermediate transfer belt device 8 is mounted in the body of the image forming apparatus 100 in a state in which tension is applied to the intermediate transfer belt 10 by the tension roller 15.

The attachment and detachment operation of the roller unit 20 is similarly performed by a worker in a manufacturing factory.

Figure 4:
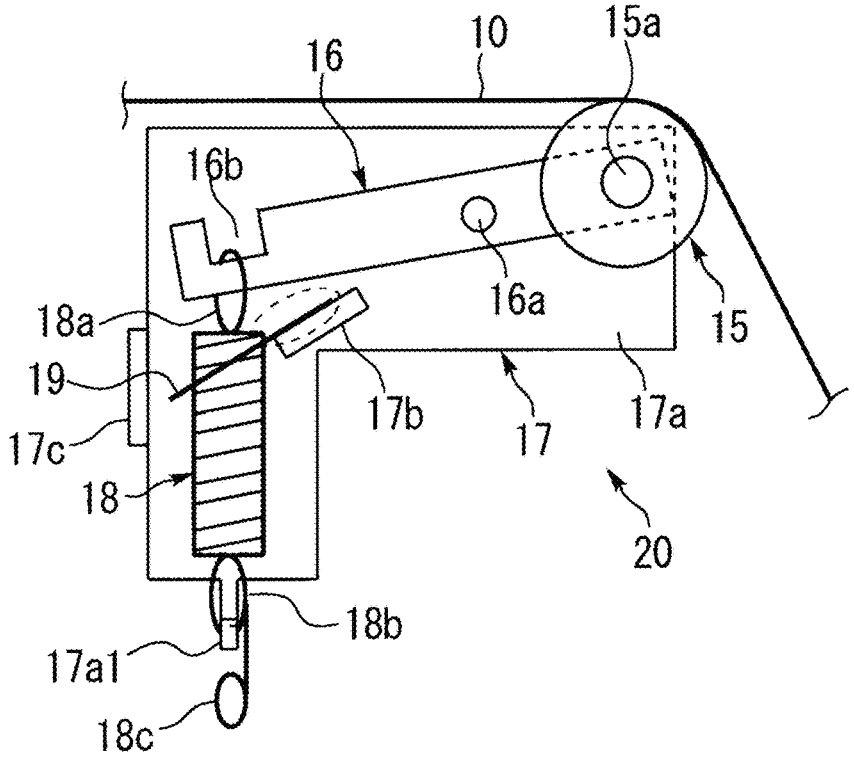
FIG. 4 is a schematic view of a configuration of a roller unit.
Figure 5:
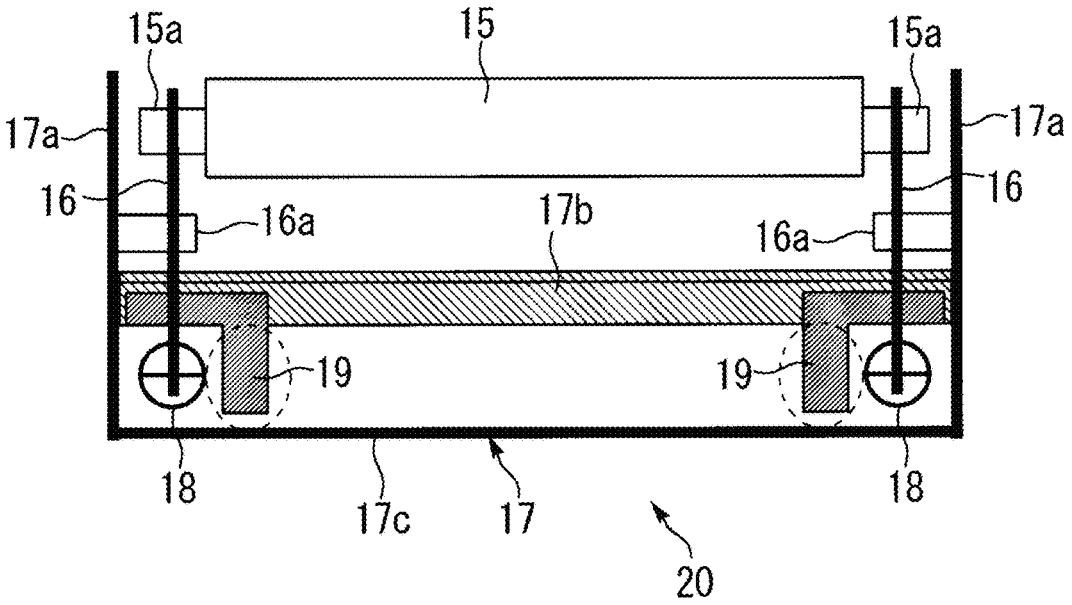
FIG. 5 is a top view of the roller unit.
Figure 6:
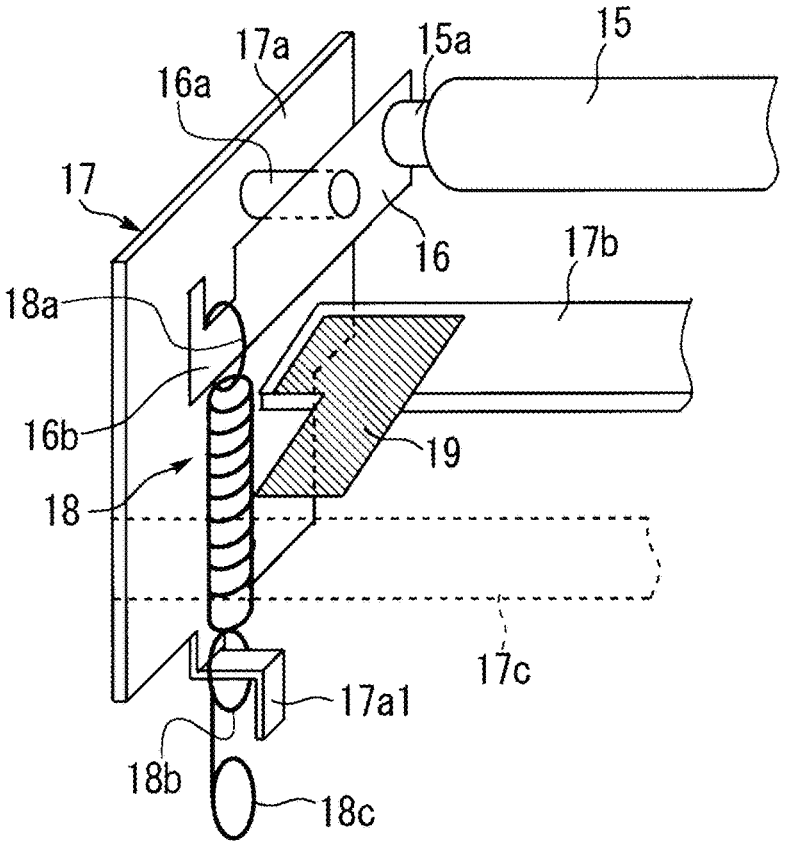
FIG. 6 is a perspective view of a part of the roller unit.

Here, as illustrated in FIGS. 4, 5, and 6, the roller unit 20 according to the present embodiment includes the tension roller 15 as a roller, arms 16 (as swing members), a holder 17 (as a unit housing), tension springs 18 (as biasing members), sheet-shaped flexible members 19 as restriction members, and the like.

The arms 16 rotatably hold the tension roller 15 (as a roller).

Specifically, shaft portions 15*a* at both axial ends of the tension roller 15 are held by the pair of arms 16 via bearings.

The holder 17 holds the arms 16 such that the arms 16 are swingable.

Specifically, the holder 17 mainly includes a pair of side plates 17*a* and stays. Each of the pair of side plates 17*a* holds a corresponding one of the pair of arms 16 such that the arms 16 are swingable. The stays (i.e. a first stay 17*b* and a second stay 17*c*) are disposed between the pair of side plates 17*a*. The tension roller 15, the arms 16, and the tension springs 18 are disposed between (inside) the pair of side plates 17*a*. Each arm 16 is held by the side plate 17*a* so as to be swingable about the support shaft 16*a*. The tension roller 15 is held on one end of the arm 16 and each of the tension springs 18 is connected to the other end of the arm 16 across the support shaft 16*a*.

Note that the first stay 17*b* as a stay limits a swing range of the arm 16. Specifically, as illustrated in FIG. 4, the first stay 17*b* is disposed below a space between the support shaft 16*a* and an arm-side hook 16*b* of the arm 16. Accordingly, the arm 16 is not swingable about the support shaft 16*a* in the counterclockwise direction without limitation and the arm 16 comes into contact with the first stay 17*b* to limit the swing range of the arm 16 in the counterclockwise direction. As a result, a disadvantage that the arm 16 swings to a position at which the tension spring 18 is easily disengaged is restrained.

The second stay 17*c* is disposed at a lateral side of the tension spring 18.

A first hook 18*a* at one end of the tension spring 18 is hooked on the arm-side hook 16*b* of the arm 16. A second hook 18*b* at the other end of the tension spring 18 is hooked on a holder-side hook 17*a*1 of the holder 17 (side plate 17*a*).

In the present embodiment, the arm-side hook 16*b* is a portion cut out in a direction in which the tension spring 18 is pulled. The holder-side hook 17*a*1 is an L-shaped plate including one plate extending in a direction orthogonal to the direction in which the tension spring 18 is pulled and the other plate extending in a direction opposite to the direction in which the tension spring 18 is pulled. However, the shape of the holder-side hook 17*a*1 is not limited thereto.

With such a configuration, as illustrated in FIG. 4, the arms 16 are biased by the tension springs 18 so as to rotate counterclockwise about the support shafts 16*a*. Accordingly, the tension roller 15 sandwiched by the arms 16 is pressed against the intermediate transfer belt 10 to apply a desired tension to the intermediate transfer belt 10.

Here, the roller unit 20 according to the present embodiment includes sheet-shaped flexible members 19. Each of the sheet-shaped flexible members 19 serves as a restriction member that restricts movement of the tension spring 18 in a state in which the second hook 18*b* of the tension spring 18 is unhooked (see FIG. 7A). Specifically, the sheet-shaped flexible member 19 is attached to the first stay 17*b* (stay).

Figure 7A:
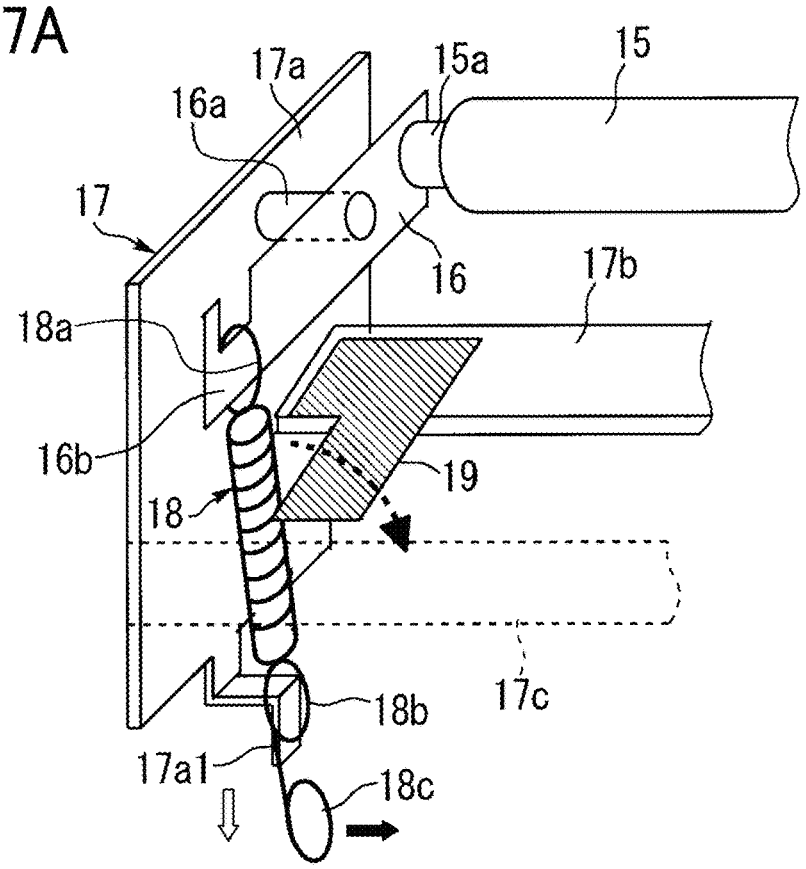
FIGS. 7A and 7B are perspective views of an operation of removing a tension spring from the roller unit.

With reference to FIG. 7A in detail, the sheet-shaped flexible member 19 (as a restriction member) restricts the movement of the tension spring 18 to prevent the second hook 18*b* from coming off from the arm-side hook 16*b* in a state in which the first hook 18*a* is unhooked from the holder-side hook 17*a*1 (so that the tension spring 18 does not come off and fall off in the direction indicated by a broken-line arrow in FIG. 7A).

As described above, the roller unit 20 is attached to and detached from the intermediate transfer belt device 8 by an operator at the time of maintenance or the like. However, if the tension roller 15 remains in a state to apply tension to the intermediate transfer belt 10 at that time, the attachment and detachment operation becomes difficult. Accordingly, such attachment and detachment operation is performed in a state in which the tension of the tension roller 15 applied to the intermediate transfer belt 10 is released.

Specifically, as illustrated in FIG. 7A, an operator detaches the roller unit 20 from the intermediate transfer belt device 8 in a state in which the second hook 18*b* is released from the holder-side hook 17*a*1. Further, the operator attaches the roller unit 20 to the intermediate transfer belt device 8 in a state in which the second hook 18*b* is released from the holder-side hook 17*a*1. Thereafter, the operator hooks the second hook 18*b* on the holder-side hook 17*a*1.

As described above, in the present embodiment, the tension roller 15 is incorporated in the roller unit 20 and is attachable to and detachable from the intermediate transfer belt device 8. Therefore, maintainability of the intermediate transfer belt device 8 is enhanced.

Further, in the present embodiment, since the sheet-shaped flexible members 19 serving as restriction members are provided in the roller unit 20, even if the tension of the tension roller 15 is released at the time of the attachment and detachment operation of the roller unit 20, a disadvantage that the tension springs 18 that bias the tension roller 15 may fall off is unlikely to occur.

Here, in the present embodiment, each of the sheet-shaped flexible members 19 (restriction member) is disposed at a position overlapping a movement trajectory drawn by the tension spring 18 when the first hook 18*a* is assumed to be unhooked from the arm-side hook 16*b* in a state in which the second hook 18*b* is unhooked from the holder-side hook 17*a*1.

That is, as illustrated in FIG. 7A, when the first hook 18*a* is unhooked from the arm-side hook 16*b* in a state in which the first hook 18*a* is unhooked, the tension spring 18 falls off while drawing the movement trajectory as illustrated by the broken-line arrow. However, the sheet-shaped flexible member 19 is disposed so as to interfere with the tension spring 18 moving in the movement trajectory and to prevent the tension spring 18 from falling off.

Note that, in the present embodiment, most of the periphery (three directions) of the tension spring 18 is surrounded by the holder 17 (the side plate 17*a*, the first stay 17*b*, and the second stay 17*c*). Accordingly, the tension spring 18 does not fall off in the directions surrounded by the holder 17 and may fall off in one direction indicated by the broken-line arrow in FIG. 7A. Therefore, in the present embodiment, the sheet-shaped flexible member 19 (restriction member) is provided only in the direction in which the tension spring 18 may fall off. On the other hand, in a case in which there is a possibility that the tension spring 18 may fall off in a plurality of directions, preferably, the restriction members are provided in all the directions (movement trajectories).

Further, in the present embodiment, the sheet-shaped flexible member 19 is disposed at a position at which the sheet-shaped flexible member 19 does not interfere with the tension spring 18 in a state in which the tension spring 18 is normally set (in a state in which the first hook 18*a* and the second hook 18*b* are engaged with the arm-side hook 16*b* and the holder-side hook 17*a*1, respectively, as illustrated in FIG. 6 and the like).

That is, as illustrated in FIGS. 4, 5, and 6, the sheet-shaped flexible members 19 do not come into contact with the tension springs 18 in the state in which the tension springs 18 are normally set.

Such an arrangement prevents the sheet-shaped flexible members 19 from interfering with the function of the tension springs 18 in normal operation mode (i.e., the function of biasing the tension roller 15). That is, a desired tension is applied to the intermediate transfer belt 10 by the tension roller 15.

Further, in the present embodiment, each of the sheet-shaped flexible members 19 serving as restriction members is cantilevered by the holder 17 (the first stay 17*b*). A free end of each of the sheet-shaped flexible members 19 is disposed at a position (portion surrounded by a broken line in FIG. 5) at which the free end of each of the sheet-shaped flexible members 19 is contactable with corresponding one of the tension springs 18. In particular, in a state in which the first hook 18*a* of the tension spring 18 is hooked on the arm-side hook 16*b* of the arm 16 and the second hook 18*b* is hooked on the holder-side hook 17*a*1 of the holder 17, the free end of the sheet-shaped flexible member 19 is provided at a position at which the free end of the sheet-shaped flexible member 19 does not contact the tension spring 18.

Specifically, the sheet-shaped flexible member 19 is made of polyethylene terephtalate (PET) having a thickness of from about 0.08 to 0.5 mm. A portion of the sheet-shaped flexible member 19 surrounded by the broken line in FIG. 4 is adhered to the first stay 17*b* as a fixed portion and the other portion of the sheet-shaped flexible member 19 protrudes from the first stay 17*b* as a non-fixed portion. Then, the non-fixed portion of the sheet-shaped flexible member 19 is contactable with the tension spring 18 at a time when the tension spring 18 may fall off, thereby restricting the movement of the tension spring 18 in the direction indicated by the broken line arrow in FIG. 7A.

Figure 7B:
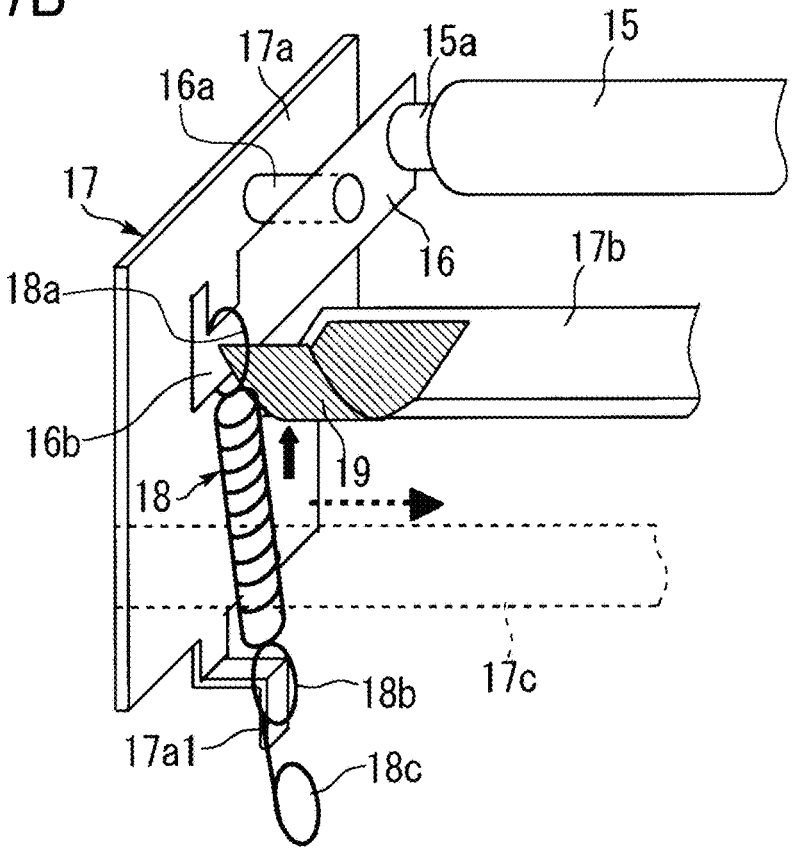

In this manner, employing the sheet-shaped flexible member 19 as a restriction member, as illustrated in FIG. 7B, allows the operator to easily attach and detach the tension spring 18 to and from the roller unit 20 without detaching the sheet-shaped flexible member 19 from the first stay 17*b* in a state in which the sheet-shaped flexible member 19 is bent in the direction indicated by the black line arrow.

Here, as illustrated in FIG. 4 and the like, in the present embodiment, the sheet-shaped flexible member 19 (restriction member) is disposed at a position closer to the first hook 18*a* than the second hook 18*b*.

That is, the sheet-shaped flexible member 19 is disposed at a position at which the sheet-shaped flexible member 19 is contactable with an upper portion of the tension spring 18, not with a lower portion of the tension spring 18.

Accordingly, even when an error occurs in the movement trajectory of the tension spring 18 indicated by the broken line in FIG. 7A (even when a movement trajectory different from an expected movement trajectory is drawn), such an arrangement as described above allows the function of the sheet-shaped flexible member 19 that prevents the tension spring 18 from falling off to be easily maintained. That is, the falling off of the tension spring 18 can be efficiently restrained.

Here, as illustrated in FIGS. 4, 6, and 7, in the present embodiment, the tension spring 18 includes a grip 18*c* at an end extending further from the second hook 18*b* of the tension spring 18 (in a lower portion in FIG. 4 and at a position at which the second hook 18*b* is unhooked).

Specifically, the grip 18*c* is an annular portion connected to the second hook 18*b* via a single wire and is formed to have a size that allows the operator to grip the grip 18*c* with a thumb and an index finger of the operator. Further, the tension spring 18 is integrally formed by a single wire rod from the first hook 18*a* to the grip 18*c* via the spring main body (winding portion) and the second hook 18*b*.

Accordingly, providing the grip 18*c* with the tension spring 18 facilitates the operation of attaching and detaching the second hook 18*b* to and from the holder-side hook 17*a*1.

With reference to FIG. 7, an operation procedure when an operator removes the tension spring 18 from the roller unit 20 is described below.

First, the intermediate transfer belt device 8 is pulled out from the body of the image forming apparatus 100. In a state in which a lower portion of the roller unit 20 is exposed, the operator inserts fingers into the roller unit 20 from below to grip the grip 18*c* of the tension spring 18. After the tension spring 18 is pulled in a direction indicated by white arrow in FIG. 7A, the tension spring 18 is slid in a direction indicated by black arrow to unhook the second hook 18*b*. Thus, the application of the tension of the tension roller 15 with respect to the intermediate transfer belt 10 is released. Accordingly, maintenance such as replacement of the intermediate transfer belt 10 and the operation of detaching the roller unit 20 from the intermediate transfer belt device 8 can be performed in this state. Further, at this time, the above-described function of the sheet-shaped flexible member 19 restrains the first hook 18*a* from coming off the arm-side hook 16*b* and the tension spring 18 from falling off.

When the tension spring 18 is removed from the roller unit 20 in the state of FIG. 7A, as illustrated in FIG. 7B, the first hook 18*a* is removed from the arm-side hook 16*b* to remove the tension spring 18 in a state in which the sheet-shaped flexible member 19 is bent in the direction of the black arrow and a space for removing the tension spring 18 is secured. Then, maintenance such as replacement of the tension spring 18 is performed.

When the tension spring 18 is attached to the roller unit 20, an operation is performed in a procedure reverse to the procedure at the time of detachment described above.

Variation 1

Figure 8:
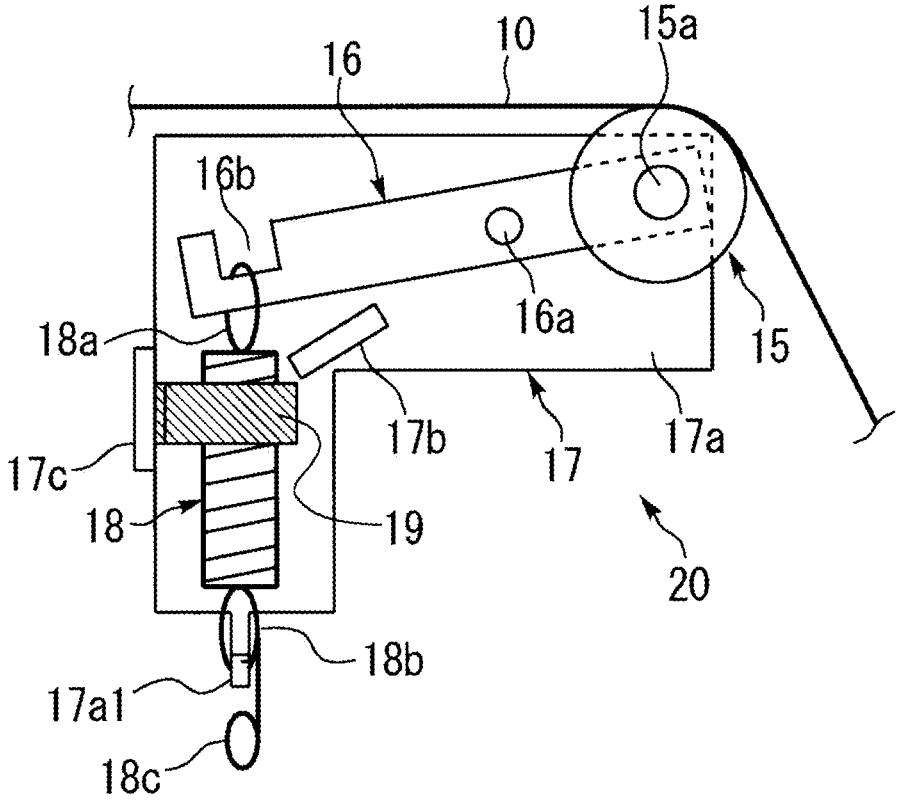
FIG. 8 is a schematic view of a configuration of a roller unit according to Variation 1.
Figure 9:
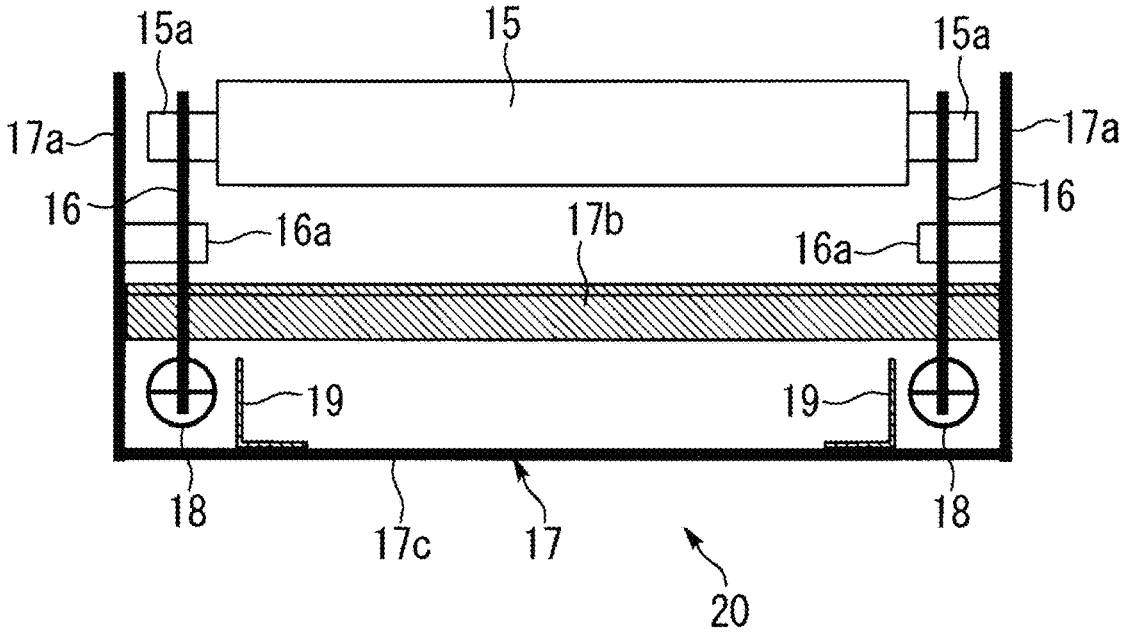
FIG. 9 is a top view of the roller unit of FIG. 8.

As illustrated in FIGS. 8 and 9, in a roller unit 20 according to Variation 1, a sheet-shaped flexible member 19 serving as a restriction member is provided to be surface-contactable with a tension spring 18.

Specifically, the sheet-shaped flexible member 19 is formed in an L-shape, and one of plates forming the sheet-shaped flexible member 19 is adhered to a second stay 17*c* as a fixed portion. The other one of the plates forming the sheet-shaped flexible member 19 is disposed so as to be surface-contactable with the tension spring 18 as a non-fixed portion (free end). Here, also in Variation 1, the sheet-shaped flexible member 19 is disposed at a position (a position at which the sheet-shaped flexible member 19 does not come into contact with the tension spring 18) at which the sheet-shaped flexible member 19 does not interfere with the normal function of the tension spring 18 and at which the sheet-shaped flexible member 19 overlaps with the movement trajectory of the tension spring 18 described with reference to FIG. 7A.

Such an arrangement restrains the tension spring 18 from falling off, also in Variation 1. In particular, in Variation 1, the movement of the tension spring 18 is limited by surface contact with the sheet-shaped flexible member 19. Thus, ensuring the force to limit the movement of the tension spring 18 is easier than in a case in which the movement of the tension spring 18 is limited by line contact or point contact with the sheet-shaped flexible member 19.

Further, the direction in which the non-fixed portion of the sheet-shaped flexible member 19 is bent is the same as the direction in which the tension spring 18 is removed from the arm 16. That is, in FIG. 9, the direction in which the non-fixed portions of the sheet-shaped flexible members 19 are bent is a left-right direction in FIG. 9. The direction in which each of the tension springs 18 is removed from corresponding one of the arms 16 is also the left-right direction in FIG. 9. Accordingly, when the tension spring 18 is detached from the arm 16, the tension spring 18 is brought into surface contact with the non-fixed portion of the sheet-shaped flexible member 19 to bend the non-fixed portion in the right direction in FIG. 9. Thus, the tension spring 18 can be detached from the arm 16. That is, the tension spring 18 can be detached from the arm 16 only by the operation of detaching the tension spring 18 from the arm 16, without securing a space for detaching the tension spring 18 by bending the sheet-shaped flexible member 19 with a finger or the like.

Variation 2

Figure 10:
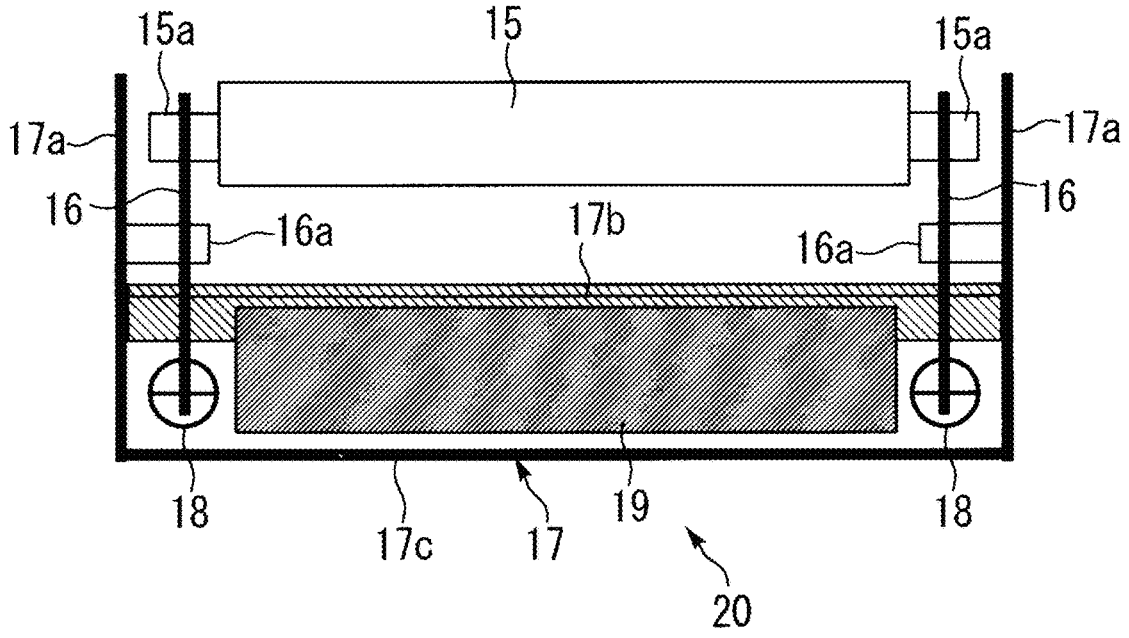
FIG. 10 is a top view of a roller unit according to Variation 2.

As illustrated in FIG. 10, in the roller unit 20 according to Variation 2, a plurality of sheet-shaped flexible members 19 serving as restriction members are not provided at longitudinal ends of a first stay 17*b*. One sheet-shaped flexible member 19 is provided so as to extend in the longitudinal direction of the first stay 17*b*. The one sheet-shaped flexible member 19 limits the movement of the pair of tension springs 18 at the both ends of the first stay 17*b*.

In Variation 2 thus configured as described above, falling off of the tension spring 18 can also be restrained.

As described above, the roller unit 20 according to embodiments of the present disclosure includes the tension roller 15 (roller), the arms 16, the holder 17, the tension springs 18, and the sheet-shaped flexible members 19 (restriction member). The arms 16 rotatably hold the tension roller 15. The holder 17 swingably holds the arms 16. Each of the tension springs 18 includes the first hook 18*a* at one end of the tension spring 18 and the second hook 18*b* at the other end of the tension spring 18. The first hook 18*a* is hooked on the arm-side hook 16*b* and the second hook 18*b* is hooked on the holder-side hook 17*a*1. The sheet-shaped flexible member 19 restricts the movement of the tension spring 18 in a state in which the second hook 18*b* of the tension spring 18 is unhooked.

Accordingly, a disadvantage in which the tension spring 18 that biases the tension roller 15 may fall off is less likely to occur.

Note that the above-described embodiments according to the present disclosure are applied to the roller unit 20 including the tension roller 15 (roller) that contacts the outer circumferential surface of the intermediate transfer belt 10 (belt member) from below. However, the present disclosure is not limited thereto. For example, the embodiments of the present disclosure can be applied to a roller unit including the tension roller 15 (roller) that contacts an inner circumferential surface of an intermediate transfer belt (belt member) or a roller unit having a tension roller (roller) that contacts an outer circumferential surface of an intermediate transfer belt (belt member) from a direction other than from below.

The above-described embodiments according to the present disclosure are applied to the roller unit 20 detachably attached to the intermediate transfer belt device 8 (belt member) including the intermediate transfer belt 10 (belt member). However, the embodiments according to the present disclosure can be applied to another roller unit detachably mounted on a belt device including other belt members (for example, transfer conveyance belt, photoconductor belt, fixing belt, and the like).

Further, although the above-described embodiments according to the present disclosure were applied to the roller unit 20 detachably attached on the intermediate transfer belt device 8 (belt member) including the tension roller 15 (roller) that applies tension to the intermediate transfer belt 10 provided in the intermediate transfer belt device 8 (belt device). However, the present disclosure is not limited thereto. For example, the embodiments according to the present disclosure can also be applied to a roller unit (roller) provided with a cleaning roller that presses against a charging roller and cleans a surface of the charging roller.

In such configurations, effects similar to those described above are also attained.

In the above-described embodiments according to the present disclosure, the sheet-shaped flexible member 19 (restriction member) is provided to restrict the movement of the tension spring 18 in a state in which the second hook 18*b* of the tension spring 18 is unhooked. However, in a configuration in which biasing of a roller is cancelled by unhooking the first hook 18*a* of the tension spring 18, a restriction member is provided to restrict the movement of the tension spring 18 in a state in which the first hook 18*a* of the tension spring 18 is unhooked.

Further, in the above-described embodiments according to the present disclosure, the sheet-shaped flexible member 19 is employed as a restriction member. However, the restriction member is not limited to thereto and restriction members in various forms can be used as long as the movement of the tension spring 18 can be restricted in a state in which the hooking of one of two hooks of the tension spring 18 is unhooked.

In such configurations, effects similar to those described above are also attained.

Note that embodiments according to the present disclosure are not limited to the above-described embodiments and it is apparent that the above-described embodiments can be appropriately modified within the scope of the technical idea of the present disclosure in addition to what is suggested in the above-described embodiments. Further, the number, position, shape, and so on of components are not limited to those of the present embodiments, and may be the number, position, shape, and so on that are suitable for implementing the present disclosure.

The suffixes Y, M, C, and K attached to each reference numeral indicate only that components indicated thereby are used for forming yellow, magenta, cyan, and black images, respectively, and hereinafter may be omitted when color discrimination is not necessary.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present disclosure.

What is claimed is:

1. A roller unit comprising:

a roller;

an arm rotatably holding the roller;

a holder swingably holding the arm;

a tension spring including:

a first hook at one end of the tension spring; and a second hook at another end of the tension spring, the first hook being hooked on an arm-side hook of the arm, the second hook being hooked on a holder-side hook of the holder; and a restriction member configured to restrict movement of the tension spring in a state in which the first hook or the second hook is unhooked.

2. The roller unit according to claim 1, wherein the restriction member is disposed at a position at which the restriction member is configured to restrict the movement of the tension spring such that the first hook is not disengaged from the arm-side hook in a state in which the second hook is unhooked from the holder-side hook.

3. The roller unit according to claim 1, wherein the restriction member is disposed at a position overlapping a movement trajectory drawn by the tension spring when the first hook is assumed to be disengaged from the arm-side hook or the second hook is assumed to be disengaged from the holder-side hook.

4. The roller unit according to claim 1, wherein the restriction member is disposed at a position closer to the first hook than the second hook.

5. The roller unit according to claim 1, wherein the tension spring includes a grip at an end extending further from the second hook of the tension spring.

6. The roller unit according to claim 1, wherein the restriction member is a sheet-shaped flexible member.

7. The roller unit according to claim 6, wherein the sheet-shaped flexible member is cantilevered by the holder, and wherein a free end of the sheet-shaped flexible member is provided in a vicinity of the tension spring.

8. The roller unit according to claim 6, wherein a free end of the sheet-shaped flexible member is provided at a position at which the free end of the sheet-shaped flexible member does not contact the tension spring in a state in which the first hook of the tension spring is hooked on the arm-side hook of the arm and the second hook is hooked on the holder-side hook of the holder.

9. The roller unit according to claim 1, further comprising a pair of arms rotatably holding the roller, the pair of arms including the arm, wherein the holder includes a pair of side plates and a stay, wherein each of the pair of side plates swingably holds a corresponding one of the pair of arms, wherein the stay is provided between the pair of side plates, and wherein the restriction member is disposed on the stay.

10. The roller unit according to claim 9, wherein the stay is disposed at a position at which the stay is configured to restrict a swing range of the arm.

11. The roller unit according to claim 1, wherein the restriction member is disposed at a position at which the restriction member is surface-contactable with the tension spring.

12. The roller unit according to claim 1, wherein the restriction member is a sheet-shaped flexible member, wherein the sheet-shaped flexible member is cantilevered by the holder, and wherein a surface of a free end side of the sheet-shaped flexible member faces the tension spring.

13. A belt device comprising:

a belt configured to travel in a predetermined direction; and the roller unit according to claim 1 detachably attached to the belt device, wherein the roller is a tension roller configured to apply tension to the belt.

14. An image forming apparatus comprising:

the belt device according to claim 13;

an image forming device configured to form a toner image on an outer circumferential surface of the belt provided in the belt device; and a belt facing member configured to form a nip to sandwich a sheet between the belt facing member and the belt.

* * * * *